US010718158B2

(12) United States Patent
Zhang

(10) Patent No.: US 10,718,158 B2
(45) Date of Patent: Jul. 21, 2020

(54) WIRE DRAWING TIGHTNESS CONTROLLER FOR EASILY DETACHABLE AND FOLDABLE SCREEN

(71) Applicant: TAROKO DOOR & WINDOW TECHNOLOGIES, INC., Gaoxiong (CN)

(72) Inventor: Zhiyuan Zhang, Gaoxiong (CN)

(73) Assignee: TAROKO DOOR & WINDOW TECHNOLOGIES, INC., Gaoxiong (CN)

( * ) Notice: Subject to any disclaimer, the term of this patent is extended or adjusted under 35 U.S.C. 154(b) by 504 days.

(21) Appl. No.: 15/305,982

(22) PCT Filed: Apr. 21, 2014

(86) PCT No.: PCT/CN2014/075830
§ 371 (c)(1),
(2) Date: Oct. 21, 2016

(87) PCT Pub. No.: WO2015/161413
PCT Pub. Date: Oct. 29, 2015

(65) Prior Publication Data

US 2017/0044825 A1 Feb. 16, 2017

(51) Int. Cl.

| | |
|---|---|
| ***E06B 9/52*** | (2006.01) |
| ***A47H 1/19*** | (2006.01) |
| *E06B 9/54* | (2006.01) |

(52) U.S. Cl.
CPC ..... *E06B 9/52* (2013.01); *A47H 1/19* (2013.01); *E06B 9/521* (2013.01); *E06B 9/522* (2013.01);

(Continued)

(58) Field of Classification Search
CPC . E06B 9/52; E06B 9/521; E06B 9/522; E06B 2009/527–528; E06B 2009/543; A47H 1/19
See application file for complete search history.

(56) References Cited

U.S. PATENT DOCUMENTS

2004/0104001 A1* 6/2004 Donnelly ..... E05F 1/025 160/371
2014/0251553 A1* 9/2014 Farntrog ..... E06B 9/52 160/99

FOREIGN PATENT DOCUMENTS

CN 103375123 A 10/2013
JP H07293158 A 11/1995
(Continued)

*Primary Examiner* — Michael E Gallion
(74) *Attorney, Agent, or Firm* — Muncy, Geissler, Olds & Lowe, P.C.

(57) ABSTRACT

A wire drawing tightness controller for an easily detachable and foldable screen, comprising: a connecting member, a wire drawing control device, a first connecting unit and a second connecting unit, wherein the connecting member is provided on a window frame, the wire drawing control device is provided with at least a control unit, and the first connecting unit and the second connecting unit are arranged between the connecting member and the wire drawing control device. By means of the arrangement of the first connecting unit and the second connecting unit, the wire drawing control device can be conveniently connected to the connecting member, and can also be easily separated from the connecting member, thereby enhancing the convenience of assembling a foldable screen.

11 Claims, 5 Drawing Sheets

(52) U.S. Cl.
CPC ... *E06B 2009/527* (2013.01); *E06B 2009/543* (2013.01)

(56) References Cited

FOREIGN PATENT DOCUMENTS

| | | | | | |
|---|---|---|---|---|---|
| JP | H10205250 | A | | 8/1998 | |
| TW | I228567 | B | | 3/2005 | |
| TW | I260364 | B | | 8/2006 | |
| TW | M383624 | U | | 7/2010 | |
| TW | 201422901 | A | | 6/2014 | |
| WO | WO-2015161413 | A1 | * | 10/2015 | ..... E06B 9/52 |

* cited by examiner

WIRE DRAWING TIGHTNESS CONTROLLER FOR EASILY DETACHABLE AND FOLDABLE SCREEN

FIELD OF THE INVENTION

The present invention relates to a component of a foldable screen, and more particularly to a wire drawing tightness controller for an easily detachable and foldable screen.

BACKGROUND OF THE INVENTION

Screen installation has become one of the necessary devices in window structures. Recently, many windows using foldable screen have been adopted in order to isolate mosquitos from the interior, and avoid blocking the view from the exterior; the mosquitos can be isolated from the interior when the screen stretches, and a view without obstacles can be provided when the screen folds.

Currently, the foldable screen provides an end disposed on a activity frame and another end disposed on a fixed frame, and drawing wires pass through a surface of the screen; The screen stretches or folds without inclining and falling through the tension of the wires, and a structure of the screen window provides with a wire drawing tightness controller for controlling the tension of the wires, such as the references from Taiwan Patent No. I260364, and No. I228567. However, the wire drawing tightness controllers from the references are disposed within the activity frame or the fixed frame, and the drawing wires are also disposed within the said frames or other frames of the foldable screen, thus drawing wires can be knotted on the wire drawing tightness controller to achieve the function of the expected controller. However, when the window of the foldable screen is removed and replaced, the frame provided with the drawing wires and the wire drawing tightness controller needs to be disassembled first, and the drawing wires and the wire drawing tightness controller are removed from the frame to replace the screen, thus replacing screen results in inconvenience.

In order to improve the above disadvantage, Taiwan Patent No. M383624 discloses a drawing wire flexible mount of foldable screen window 1, which comprises a wire bolt 11 and a shell cover 12 (see FIGS. 1 and 2), wherein an end of the wire bolt is provided with a ditch, and drawing wires L are fixed in the ditch (not shown). Another end of the wire bolt is provided with a polygonal plug 111 formed with a screw hole 112. The shell cover 12 is configured to receive the wire bolt 11, and two sides of the shell cover 12 corresponding to a window frame A are formed with an embedded slot 121 to embed in the window frame A. Therefore, an workpiece is inserted into the screw hole 112 of the polygonal plug 111 to turn the wire bolt 11 when using it, and the drawing wires L winds around the wire bolt 11 or not to achieve the function of controlling the drawing wires L tightness.

As described above, the structure of Patent No. M383624 can be embedded from the external part of the window frame to improve the inconvenience that the wire drawing tightness controller is disposed within the window frame. However, when the window frame uses extrusion molding, the mold is used for a long time, causing abrasions, and the size of the window frame is sometimes over the range of the original settings. Thus the installation of the shell cover is difficult, and the structure of Patent No. M383624 cannot exert the function of controlling the drawing wires tightness.

SUMMARY OF THE INVENTION

A primary object of the present invention is to provide a wire drawing tightness controller for an easily detachable and foldable screen, which is able to be disposed on the external part of the window frame, and is not limited to the changing size of the window frame to overcome the difficult installation.

Another object of the present invention is to provide a wire drawing tightness controller for an easily detachable and foldable screen to increase the convenience of the detachable and foldable screen.

To achieve the above object, the present invention provides a wire drawing tightness control for an easily detachable and foldable screen, which comprises a connecting member; a wire drawing control device disposed on the connecting member, and including at least one control unit; a first connecting unit and a second connecting unit disposed between the connecting member and the wire drawing control device, wherein the first connecting unit and the second connecting unit are configured to be combined with and detached from each other.

The beneficial effects of the present invention are such that a wire drawing tightness control for an easily detachable and foldable screen is provided, which comprises a connecting member; a wire drawing control device disposed on the connecting member, and including at least one control unit; a first connecting unit and a second connecting unit disposed between the connecting member and the wire drawing control device, wherein the first connecting unit and the second connecting unit are configured to be combined with and detached from each other.

Figure 1:
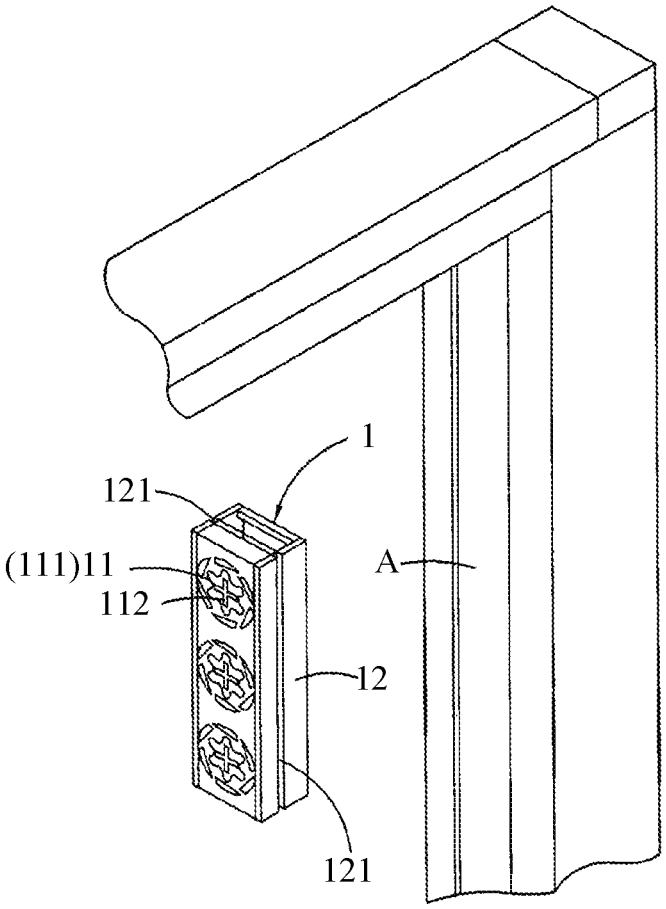
FIG. 1 PRIOR ART
FIG. 1 is a schematic view of a prior art.
Figure 2:
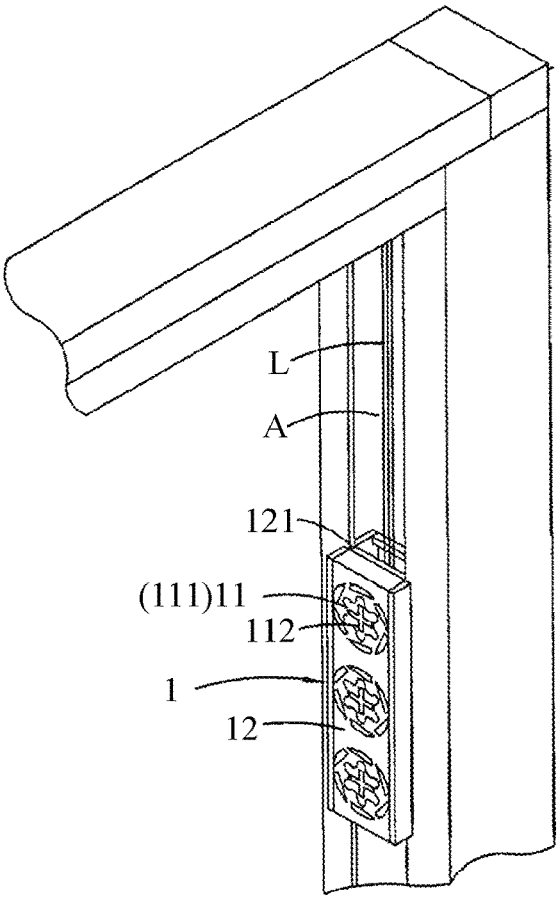
FIG. 2 PRIOR ART
FIG. 2 is another schematic view of a prior art.

REFERENCE NUMERALS drawing wire flexible mount of foldable screen window 1;
connecting member 2;
wire drawing control device 3;

first connecting unit 4;
second connecting unit 5;
wire bolt 11;
shell cover 12;
annular wall 21;
cover 22;
upright plate 23;
decorative strip 24;
body 31;
base 32;
screw hole 41;
engaging hook 42;
pivot slot 43;
tab 51;
screw 52;
engaging portion 53;
pivot 54;
plug 111;
screw hole 112;
embedded slot 121;
engaging rib 231;
abutting rib 232;
side edge 251;
engaging portion 31A;
engaging protrusion 31B;
control unit 311;
wire groove 312;
hollow hole 313;
gear shaft 314;
limit portion 315;
gear 316;
through hole 317;
drive slot 318;
stopper 319;
wire guiding groove 321;
through hole 322;
hook portion 323;
engaging recess 324;
opening 431;
through hole 511;
window frame A;
drawing wire L.

DETAILED DESCRIPTION OF THE PREFERRED EMBODIMENTS

Figure 3:
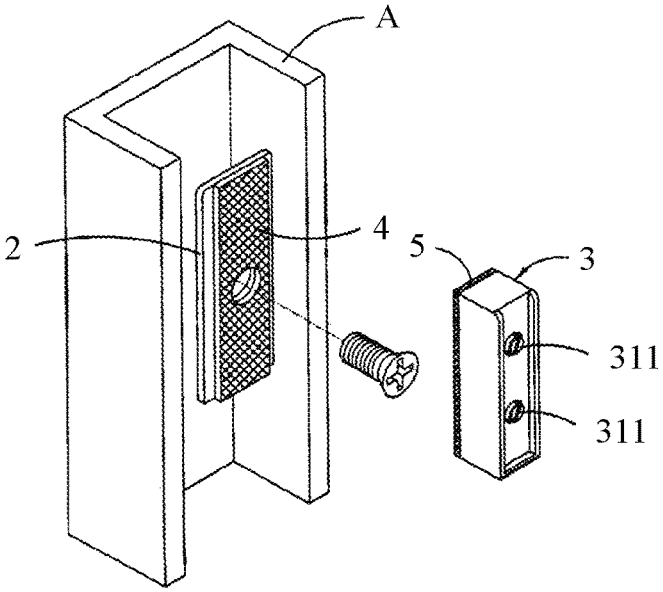
FIG. 3 is a schematic view of the present invention.
Figure 4:
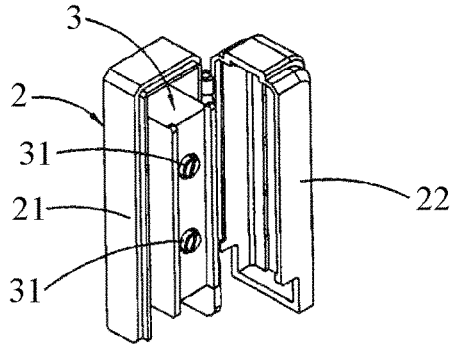
FIG. 4 is a schematic view of a cover of a decorative strip of the present invention.
Figure 5:
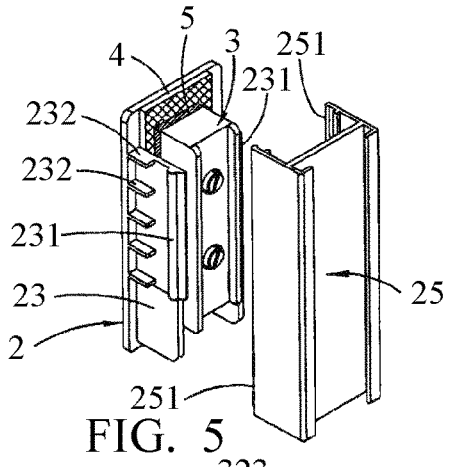
FIG. 5 is a schematic view of a wire drawing tightness controller.

Refer to FIGS. 3 and 4, a wire drawing tightness control for an easily detachable and foldable screen according to an embodiment of the present invention is illustrated, which comprises a connecting member 2, a wire drawing control device 3, a first connecting unit 4, and a second connecting unit 5, wherein the connecting member 2 is disposed on the external part of a window frame A through a fixing means, and the fixing means can adopt one of screwing, engaging, boding, and embedding. The connecting member 2 is screwed on window frame A in the embodiment, but is not limited thereto. Any fixing means can be adopted to fix the connecting member 2 on the window frame A, which is the scope of the present invention; Refer to FIG. 4, an edge portion of the connecting member 2 is disposed with an annular wall 21, and the annular wall 21 is pivoted with a cover 22. Dust or dirt can be avoided from the exterior by disposing the cover 22, and the shielding effect can be achieved. Refer to FIG. 5, which is a connecting member 2 according to another embodiment of the present invention, wherein the connecting member 2 comprises two upright plates 23 opposite each other, and the wire drawing control device 3 is received between the upright plates 23. The upright plates 23 are provided with an engaging rib 231 and a plurality of abutting ribs 232 thereon, wherein a decorative strip 25 is engaged with the engaging rib 231, and the abutting ribs 232 abut against side edges 251 of the decorative strip 25, thus dust or dirt can be avoided from the exterior, and the shielding effect can be achieved by disposing the decorative strip 25.

Figure 6:
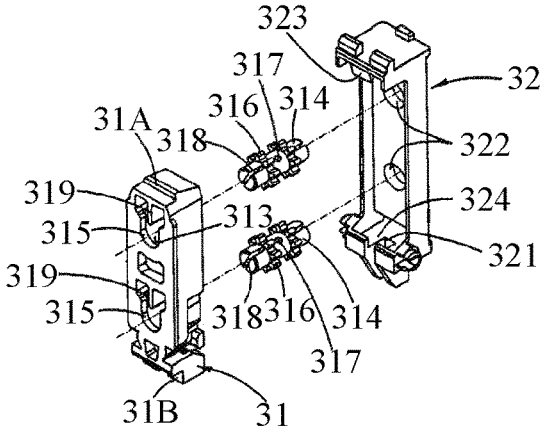
FIG. 6 is a schematic view of a wire drawing tightness controller.
Figure 7:
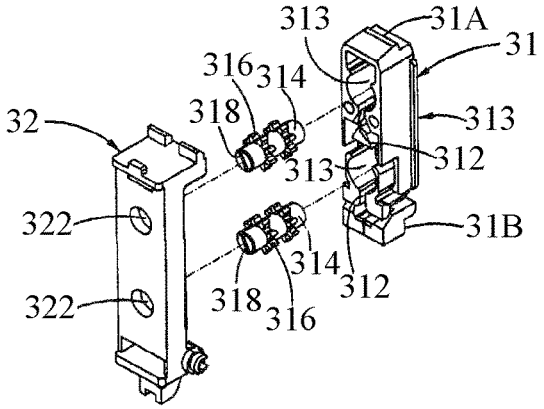
FIG. 7 is another schematic view of a wire drawing tightness controller.

Refer to FIGS. 6 and 7, the wire drawing control device 3 can be disposed on the connecting member 2, and easily detached from the connecting member 2. The wire drawing control device 3 at least comprises a body 31 and a base 32, wherein the body 31 includes a control unit 311 and a wire groove 312; the control unit 311 comprises a hollow hole 313 and a gear shaft 314, and the hollow hole 313 communicates with the wire groove 312, thus a drawing wire (not shown) passed into the wire groove 312 can also be passed into the hollow hole 313. The gear shaft 314 is received in the hollow hole 313, and an opening edge of the hollow hole 313 is provided with a limited portion 315, thus the gear shaft 314 is received in the hollow hole 313 without dropping. The gear shaft 314 provides a gear 316 and a through hole 317, and the drawing wire passed into the hollow hole 313 is knotted on the through hole 317. An end of the gear shaft 314 is provided with a drive slot 318 to drive the gear shaft 314 turning by a tool; a stopper 319 is extended from an inner wall of the hollow hole 313 to stop between two teeth of the gear 316 of the gear shaft 314. The drawing wire winds on the gear shaft 314 when the gear shaft 314 is turned to control the wire drawing tightness, and the gear shaft 314 can be stopped when the wire drawing tightness is controlled to a suitable state. At this time, the stopper 319 is stopped between two teeth of the gear 316 of the gear shaft 314, thus the gear shaft 314 can avoid draw back by the drawing wire.

Refer still to FIGS. 6 and 7, the body 31 is combined on the base 32; and the base 32 includes a wire guiding groove 321 and a through hole 322 related to the wire groove 312 and the hollow hole 313 of the body 31, wherein the wire guiding groove 321 is communicated with the wire groove 312 of the body 31; The through hole 322 is provided to drive the gear shaft 314 of the body 31 turning by a tool, thus the wire drawing tightness can be controlled from the external part of the base 32. The base 32 provides a hook portion 323 and an engaging recess 324, and the body 31 is provided with an engaging portion 31A and an engaging protrusion 31B related to the hook portion 323 and the engaging recess 324 of the base 32, respectively, thus the body 31 can be engaged on the external part of the base 32, and can easily be detached from the base 32.

Figure 8:
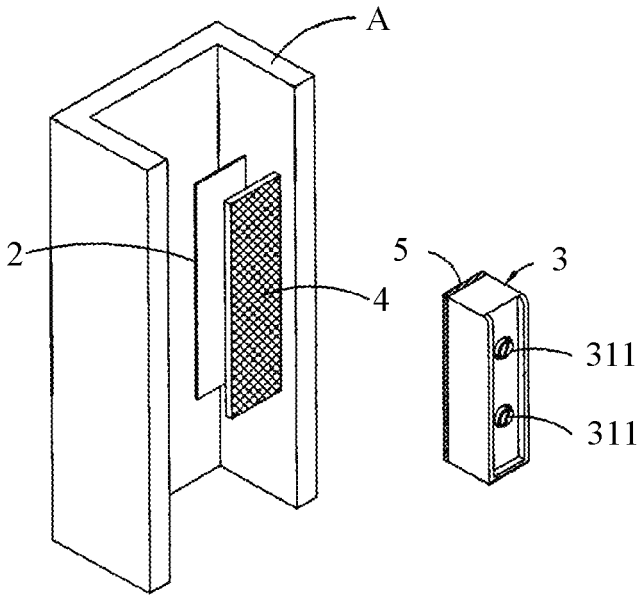
FIG. 8 is a schematic view of a first connecting unit and a second connecting unit of a first embodiment of the present invention.

Furthermore, the first connecting unit 4 and the second connecting unit 5 are disposed between the connecting member 2 and the wire drawing control device 3, wherein the first connecting unit 4 and the second connecting unit 5 are configured to be combined with and detached from each other. Refer to FIG. 8, a first connecting unit 4 and a second connecting unit 5 to a first embodiment of the present invention are illustrated, wherein the first connecting unit 4 is a hook fastener (or a loop fastener) disposed on the connecting member 2, and the second connecting unit 5 is a loop fastener (or a hook fastener) disposed on the wire drawing control device 3. The first connecting unit 4 and the second connecting unit 5 are configured to be conveniently combined with and easily detached from each other by using the hook fastener and the loop fastener. In the embodiment, the connecting member 2 is an adhesive layer, such as sided adhesive or viscose, thus the connecting member 2 can be bonded on the external part of the window frame A directly.

Figure 9:
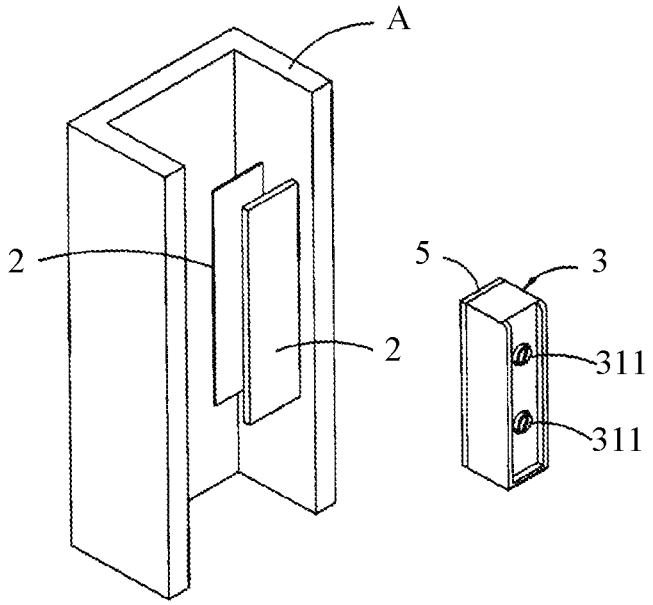
FIG. 9 is a schematic view of a first connecting unit and a second connecting unit of a second embodiment of the present invention.

Refer to FIG. 9, a first connecting unit 4 and a second connecting unit 5 to a second embodiment of the present invention are illustrated, wherein the first connecting unit 4 is also a magnetically attracting component (or a magnetically attracted component) disposed on the connecting member 2. In the embodiment, the connecting member 2 is an adhesive layer, thus the connecting member 2 can be bonded on the external part of the window frame A directly; The second connecting unit 5 is a magnetically attracted component (or a magnetically attracting component) disposed on the wire drawing control device 3, thus the first connecting unit 4 and the second connecting unit 5 to a second embodiment can be magnetically attracted with each other, so that the wire drawing control device 3 can be combined with and detached from the connecting member 2.

Figure 10:
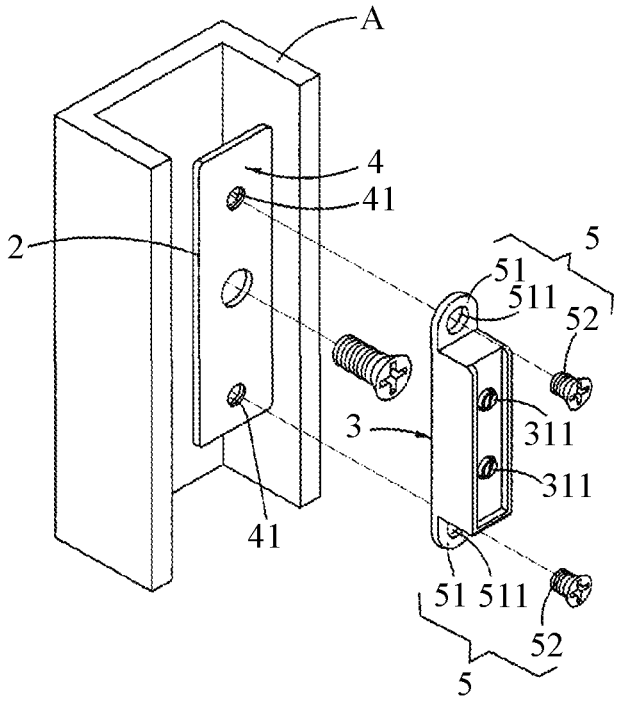
FIG. 10 is a schematic view of a first connecting unit and a second connecting unit of a third embodiment of the present invention.

Refer to FIG. 10, a first connecting unit 4 and a second connecting unit 5 to a third embodiment of the present invention are illustrated, wherein the first connecting unit 4 at least comprises a screw hole 41 disposed on the connecting member 2. In the embodiment, the connecting member 2 is a plate, and the second connecting unit 5 comprises a tab 51 and a screw 52 corresponding to the first connecting unit 4, wherein the tab 51 is provided with a through hole 511, and the screw 52 passes through the through hole 511 and then screw-connects to the screw hole 41 of the first connecting unit 4, thus the second connecting unit 5 can be screwed on the first connecting unit 4. Therefore, the wire drawing control device 3 can be easily combined and easily detached in the embodiment by screwing the screw 52.

Figure 11:
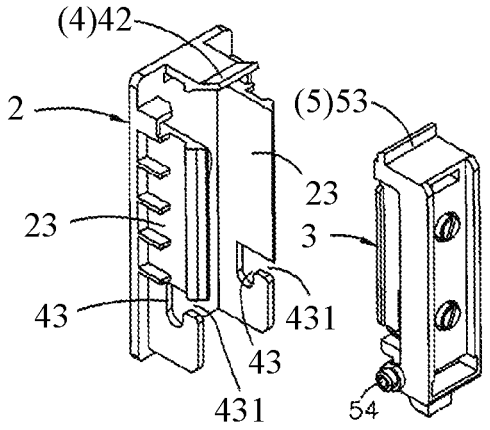
FIG. 11 is a schematic view of a first connecting unit and a second connecting unit of a forth embodiment of the present invention.

Refer to FIG. 11, a first connecting unit 4 and a second connecting unit 5 to a forth embodiment of the present invention are illustrated, wherein the first connecting unit 4 comprises an engaging hook 42 and two pivot slots 43, and the engaging hook 42 is formed on the connecting member 2. In the embodiment, the connecting member 2 is a plate, and the pivot slots 43 are formed on the upright plates 23 of the connecting member 2, respectively. The pivot slots 43 are L shaped, and an end of each of the pivot slots 43 is formed with an opening 431 on the corresponding upright plates 23. The second connecting unit 5 is disposed on the wire drawing control device 3, and the second connecting unit 5 comprises an engaging portion 53 and two pivots 54 disposed on the wire drawing control device 3 and corresponding to the engaging hook 42 and the pivot slots 43 of the first connecting unit 4, respectively. Thus, when the embodiment is used, the pivots 54 of the second connecting unit 5 are inserted into the pivot slots 43 through the opening 431 above the upright plates 23 of the connecting member 2, so that the wire drawing control device 3 can be pivoted in the pivot slots 43, and then the wire drawing control device 3 is pivoted to combine the engaging portion 53 of the second connecting unit 5 on the wire drawing control device 3 and the engaging hook 42 of the first connecting unit 4, thus the wire drawing control device 3 can be combined with the connecting member 2, the entire installation is very convenient, and the easily detachable effect can be achieved.

According to what is described above, the present invention is not limited to the changing size of the window frame when the present invention is used, and the easily detachable and foldable screen can be achieved.

The above descriptions are only preferred embodiments of the present invention but are not used to limit the features of the present invention. As long as a reinvention uses technical means or creation principles related to the present invention, the reinvention still falls within the scope of the invention. One skilled in the art, without departing from the spirit and scope of the invention, can make various modifications and variations, so it is reasonable that the range of the scope of the invention is defined by the claims.

What is claimed is:

1. A wire drawing tightness control for an easily detachable and foldable screen, comprising:

a connecting member;

a wire drawing control device disposed on the connecting member, and including at least one control unit;

a first connecting unit and a second connecting unit disposed between the connecting member and the wire drawing control device, wherein the first connecting unit and the second connecting unit are configured to be combined with and detached from each other;

wherein the connecting member comprises two upright plates opposite each other, and the upright plates are at least provided with an engaging rib thereon, wherein a decorative strip is engaged with the engaging rib.

2. The wire drawing tightness control for an easily detachable and foldable screen according to claim 1, wherein the upright plates are at least provided with a plurality of abutting ribs thereon and the abutting ribs abut against side edges of the decorative strip.

3. The wire drawing tightness control for an easily detachable and foldable screen according to claim 1, wherein the first connecting unit disposed on the connecting member is a hook fastener or a loop fastener, and the second connecting unit disposed on the wire drawing control device is a loop fastener or a hook fastener related to the hook fastener or the loop fastener of the first connecting unit, respectively.

4. The wire drawing tightness control for an easily detachable and foldable screen according to claim 1, wherein the first connecting unit disposed on the connecting member is a magnetically attracting component or a magnetically attracted component, and the second connecting unit disposed on the wire drawing control device is a magnetically attracted component or a magnetically attracting component related to the magnetically attracting component or the magnetically attracted component of the first connecting unit, respectively.

5. The wire drawing tightness control for an easily detachable and foldable screen according to claim 2, wherein the connecting member is an adhesive layer.

6. The wire drawing tightness control for an easily detachable and foldable screen according to claim 1, wherein the first connecting unit at least comprises a screw hole disposed on the connecting member, and the second connecting unit at least comprises a tab and a screw disposed on the wire drawing control device and corresponding to the screw hole of the first connecting unit, wherein the tab is provided with a through hole, and the screw passes through the through hole of the second connecting unit and then screw-connects to the screw hole of the first connecting unit.

7. The wire drawing tightness control for an easily detachable and foldable screen according to claim 2, wherein the wire drawing control device is received between the upright plates of the connecting member, and the first connecting unit comprises an engaging hook and two pivot slots; the engaging hook is formed on the connecting member close to one notch of the receiving groove, and the pivot slots are formed on the upright plates of the connecting member, respectively; an end of each of the pivot slots is formed with an opening on the corresponding upright plates; and the second connecting unit comprises an engaging portion and two pivots disposed on the wire drawing control device and corresponding to the engaging hook and the pivot slots of the first connecting unit, respectively.

8. The wire drawing tightness control for an easily detachable and foldable screen according to claim 1, wherein the control unit at least comprises a hollow hole and a gear shaft received in the hollow hole, and the gear shaft provides a gear and a through hole, and a stopper is extended from an inner wall of the hollow hole and corresponding to a portion between two teeth of the gear of the gear shaft.

9. The wire drawing tightness control for an easily detachable and foldable screen according to claim 8, wherein the wire drawing control device at least comprises a body and a base, and the control unit is disposed on the body; the body includes a wire groove communicated with the hollow hole of the control unit; the body is combined on the base; and the base includes a wire guiding groove related to the wire groove of the body, and the wire guiding groove is communicated with the wire groove of the body.

10. The wire drawing tightness control for an easily detachable and foldable screen according to claim 9, wherein the base provides a hook portion and an engaging recess, and the body is provided with an engaging portion and an engaging protrusion related to the hook portion and the engaging recess of the base, respectively.

11. The wire drawing tightness control for an easily detachable and foldable screen according to claim 3, wherein the connecting member is an adhesive layer.

* * * * *